US009409632B2

(12) United States Patent
Koestner

(10) Patent No.: US 9,409,632 B2
(45) Date of Patent: Aug. 9, 2016

(54) CABIN FOR A FLOATING INSTALLATION WITH LINES WHICH CONTRIBUTE TO REINFORCEMENT

(71) Applicant: Dr. Ing. h.c. F. Porsche Aktiengesellschaft, Stuttgart (DE)

(72) Inventor: Matthias Koestner, Sachsenheim (DE)

(73) Assignee: Dr. Ing. h.c. F. Porsche Aktiengesellschaft (DE)

( * ) Notice: Subject to any disclaimer, the term of this patent is extended or adjusted under 35 U.S.C. 154(b) by 0 days.

(21) Appl. No.: 14/402,927

(22) PCT Filed: Mar. 15, 2013

(86) PCT No.: PCT/EP2013/000792
§ 371 (c)(1),
(2) Date: Nov. 21, 2014

(87) PCT Pub. No.: WO2013/174463
PCT Pub. Date: Nov. 28, 2013

(65) Prior Publication Data

US 2015/0144046 A1 May 28, 2015

(30) Foreign Application Priority Data

May 23, 2012 (DE) ..... 10 2012 104 439

(51) Int. Cl.
*B63B 29/02* (2006.01)
*B63B 11/00* (2006.01)

(52) U.S. Cl.
CPC ..... *B63B 29/02* (2013.01); *B63B 11/00* (2013.01); *B63B 29/025* (2013.01)

(58) Field of Classification Search
CPC ..... B63B 29/02; B63B 29/025; B63B 11/00; B63B 3/00
USPC ..... 114/71; 52/241
See application file for complete search history.

(56) References Cited

U.S. PATENT DOCUMENTS

| | | | | |
|---|---|---|---|---|
| 2,079,635 | A | 5/1937 | Sharp | |
| 4,528,928 | A | 7/1985 | Virta et al. | |
| 6,053,120 | A * | 4/2000 | Shields | 114/71 |

FOREIGN PATENT DOCUMENTS

| | | |
|---|---|---|
| AT | 5511 | 7/2002 |
| DE | 19828505 | 1/2000 |
| EP | 1429436 | 6/2004 |
| FR | 2391901 | 12/1978 |
| GB | 2088292 | 6/1982 |
| WO | 9963173 | 12/1999 |
| WO | 03085224 | 10/2003 |
| WO | 2004041633 | 5/2004 |

OTHER PUBLICATIONS

English Translation of International Preliminary Report on Patentability—Nov. 25, 2014.

* cited by examiner

*Primary Examiner* — Lars A Olson
(74) *Attorney, Agent, or Firm* — Gerald E. Hespos; Michael J. Porco; Matthew T. Hespos

(57) ABSTRACT

The invention relates to a cabin (70) for a floating installation, in particular for a ship (60), having a room unit (1) which is bounded at least by a ceiling (10) and walls (20), and lines (30) which supply the room unit (1), in particular with air, water, data, power, illumination, etc. Provision is made according to the invention for the lines (30) to extend in the room unit (1) in such a way that the lines (30) simultaneously act as reinforcing means for the room unit (1).

15 Claims, 4 Drawing Sheets

CABIN FOR A FLOATING INSTALLATION WITH LINES WHICH CONTRIBUTE TO REINFORCEMENT

BACKGROUND

1. Field of the Invention

The invention relates to a cabin for a floating installation, in particular for a ship, having a room unit, which is delimited at least by a ceiling and by walls, and conduits, which serve for providing a supply, in particular of air, water, data, electricity, lighting, etc., to the room unit.

2. Description of the Related Art

DE 198 28 505 A1 discloses a ship cabin which is composed of a load-bearing floor, a ceiling and wall elements. The floor is formed from a multiplicity of layers which exhibit different flexural strength and elasticity, whereby the cabin has improved characteristics with regard to its strength and basic rigidity. This is of great importance in particular during the transportation of the cabin and during the installation of the cabin on the ship. Consequently, transportation damage can be avoided owing to the increased stiffening of the cabin as a result of the use of the above-mentioned floor. It has disadvantageously been found that the use of said special floor for increasing the flexural strength of the cabin involves great outlay in terms of material and assembly.

It is an object of the present invention to eliminate the disadvantages mentioned above, in particular to create a cabin which exhibits the required basic rigidity during transportation and when it is installed on the floating installation, in particular on the ship, whereby damage to the cabin can be virtually prevented.

SUMMARY OF THE INVENTION

It is provided according to the invention that the conduits run in the room unit such that the conduits simultaneously act as stiffening means for the room unit.

According to the invention, the conduits are supply conduits which can supply different media to the cabin. For example, the supply conduits can supply air, water, data, electricity, lighting etc. to the cabin. According to the invention, the conduits are integrated in the room unit such that said conduits simultaneously perform a stiffening function for the room unit. Here, it may be expedient for the conduits to be arranged along the length extent and/or the width extent and/or the height extent of the room unit, which contributes considerably to increasing the basic rigidity of the cabin.

In a further measure that improves the invention, it may be provided that the conduits are integrated in the room unit such that the conduits are accessible from the interior of the room unit. The integration of the conduits in the room unit is conducive to the possibility of optimizing the required cabin structural space in a floating installation, in particular in a ship, which results, for example, in an additional deck (a greater number of cabins for the same ship dimensions) or a lower ship, whereby a lower center of gravity of the ship can be realized. Consequently, less aluminum needs to be installed in the upper region of the ship. Furthermore, in this way, the air resistance can be lowered, which can save many tonnes of fuel even in the case of slow ships. By contrast to the prior art, in which, inter alia, the conduits are arranged on the outer side of the cabin, the integration according to the invention of the supply conduits in the room unit yields an increased basic rigidity of the cabin, wherein at the same time, a major advantage is that the conduits are accessible from the interior of the room unit. It has been found that, during the installation of the cabin and during later repair work and/or maintenance work, accessibility to the supply conduits from the interior of the room unit can be an advantage. The arrangement of the supply conduits on the outer side of the room unit has the major disadvantage that said region is only accessible with difficulty, in particular because only little structural space is available for the technician in said region. The relocation of the supply conduits into the room unit is thus highly conducive to keeping the assembly outlay or the repair and maintenance outlay as low as possible. A further advantage is that, owing to the integration of the supply conduits in the room unit, the supply conduits are protected during the transportation of the cabin and when the cabin is installed on the floating installation, in particular on the ship, and said supply conduits thus cannot—as in the prior art—be damaged by any impact against the outer side of the room unit.

It may be advantageous for the room unit to be transported into the installation, in particular into the ship, without a floor. This means that the room unit is formed only from a ceiling and the associated walls. This box, which is open on one side, is placed onto the ship floor and subsequently correspondingly fastened to the ship floor, which will be discussed further below.

Provision may also be made for the conduits to be arranged in the edge region between the ceiling and the wall and/or in the edge region between the wall and a floor of the room unit. It is achieved in this way that the cabin is made more torsionally rigid and flexurally rigid. Since the conduits are integrated in the room unit, the height of the room unit or of the cabin can be reduced. At the same time, fewer collisions can occur as the cabin is transported and introduced into the floating installation. Through the integration of the conduits in the interior of the room unit, it is additionally possible to achieve improved acoustic characteristics for each individual cabin. The conduits are advantageously situated behind a cover element, which may for example be in the form of a decorative strip. The cover element is preferably matched to the overall design of the cabin. This means that, for example, the color of the cover element or of the surface or material thereof may be matched to the interior of the cabin. To permit access to the supply conduits, the cover element is advantageously removable. A clip-type fastening and/or a fastening involving detent means is for example conceivable. Alternative fastening types, for example a screw connection, are also conceivable.

According to the invention, it is possible for the conduits to extend through a receiving body which is fastened to the ceiling and/or to the wall and/or to the floor, in particular for the receiving body to be metallic. The receiving body may for example be an extruded profile which serves as a framework for the supply conduits. All fastening types are conceivable for the fastening of the receiving body to the ceiling, to the wall and to the floor. In one possible embodiment of the invention, the receiving body is situated in the interior of the room unit, wherein the receiving body is provided with the cover element, which reliably conceals the supply conduits from the viewer situated in the cabin. In a further possibility of the invention, the receiving body constitutes a load-bearing connecting piece to which the ceiling and the wall are fastened. It is likewise conceivable for the receiving body, which serves as a load-bearing connecting piece, to connect the wall to a floor of the cabin. The receiving body is advantageously highly conducive to increasing the rigidity of the cabin.

It is furthermore conceivable according to the invention for the receiving body to have at least one chamber in which the conduits extend, in particular for multiple mutually separate chambers to be provided. The chambers may be completely separate from one another. It may likewise be provided that connecting regions exist between the chambers, such that the chambers are open to one another in defined regions. An advantage of different chambers is that defined supply conduits can be led separately in the respective chamber. For example, it may be of technical importance for defined supply conduits not to be led in the same chamber. Here, safety aspects may be of high importance. For example, it may be advantageous for water conduits to be led separately from electrical lines in separate chambers.

Furthermore, it is conceivable for the receiving body to have at least one fastening receptacle on which the wall and/or the ceiling is arranged. Here, the fastening receptacle may form a monolithic component with the receiving body. Here, the fastening receptacle serves for reliably holding the wall and/or the ceiling on the receiving body. Here, in one possible embodiment of the invention, it is conceivable for the wall and/or the ceiling to be held in positively locking fashion in the fastening receptacle. It is additionally conceivable for the wall and/or the ceiling to be held in non-positively locking and/or cohesive fashion in the fastening receptacle. In one possible embodiment of the receiving body, the fastening receptacle is for example in the form of a U-shaped profile in which the wall and/or the ceiling are reliably held.

To prevent any movements of the conduits within the chambers, it may be provided according to the invention that, in the chamber, the space in which the conduits are situated is filled with a material. The material, which serves as a type of filler material, may be introduced into the chamber and additionally perform further functions; in particular, said filler material may serve for noise deadening. The filler material is preferably situated in the chamber and preferably holds the conduits in their desired position, whereby any rattling noises, which may be generated for example in the event of contact between the conduit and the receiving body material, can be prevented. Alternatively and/or in addition, the invention also encompasses the possibility of the conduits being fixed in their position within the receiving body by way of plastics cable ties.

The cover element may advantageously have at least one of the following elements: lighting element, sensor, loudspeaker, display, plug socket, network connection, sprinkler element, camera, air outlet/inlet opening. As lighting elements, use may be made for example of LEDs which may serve for illuminating the interior of the room unit. Alternatively and/or in addition, an emergency light may be provided on the cover element, which emergency light receives energy via the supply conduit. With regard to the sensor, it is for example possible for a motion sensor to be provided on the cover element in order to provide lighting only in the event of a defined movement within the cabin.

The ceiling and the walls are advantageously formed from a multiplicity of ceiling elements and wall elements that are fastened to one another. The ceiling elements and wall elements may for example be formed from an insulating material. It is likewise advantageous for the material of the ceiling elements and of the wall elements to exhibit adequate strength, in particular also in the event of a fire. Furthermore, the material of the ceiling elements and of the wall elements may exhibit high imperviousness and low thermal conductivity.

Ease of assembly may be increased by virtue of the ceiling element being fastened to the ceiling element adjacent thereto by way of a tongue and groove connection, and/or the wall element being fastened to the wall element adjacent thereto by way of a tongue and groove connection. The tongue and groove connection may additionally be supplemented by a non-positively locking and/or positively locking and/or cohesive connection. For example, a screw connection additionally in the region of the tongue and groove connection can ensure reliable fastening of the individual ceiling elements and wall elements to one another. The material of the ceiling elements and/or of the wall elements is advantageously surrounded by thin sheet metal. The material of the ceiling elements and of the wall elements may also be in the form of rigid mineral wool.

In one possible embodiment of the invention, it may be possible for a metallic frame profile to be fastened to the floor of the room unit, wherein the wall element is held in the frame profile. The frame profile is for example in the form of a U-shaped profile in which the wall element can be reliably fixed. Furthermore, the frame profile may be welded to the ship floor, such that the cabin is reliably held in its defined position within the ship.

According to the invention, a ship having multiple cabins is provided, wherein each cabin is formed by a room unit which is delimited at least by a ceiling and by walls, and conduits are provided which serve for providing a supply, in particular of air, water, data, electricity, lighting, etc., to the room unit. Furthermore, the conduits run in the room unit such that the conduits simultaneously act as stiffening means for the room unit.

In one possible embodiment of the invention, the floor of the cabin may be formed by a ship floor, wherein the walls are held, at the floor side, in a metallic frame profile, in particular in a U-shaped profile, wherein the frame profile is fastened, in particular welded to the ship floor.

The cabins may advantageously be arranged one on top of the other and/or adjacent to one another within the ship. Owing to the conduits according to the invention, which serve to stiffen each cabin, the cabins according to the invention can be arranged one on top of the other. Here, the floor of the upper cabin may simultaneously be the ceiling of the lower cabin. A reduction of the structural height of the ship can be achieved in this way. It is likewise possible for additional ship decks to be realized. Furthermore, the weight of the ship can be reduced considerably, because fewer metallic frame profiles, which jointly define the floor region of each ship deck, are required.

Further advantages, features and details of the invention will emerge from the following description, in which, with reference to the drawings, the invention is described in terms of multiple exemplary embodiments. Here, the features mentioned in the claims and in the description may be essential to the invention individually or in any desired combination.

DETAILED DESCRIPTION OF THE PREFERRED EMBODIMENTS

Figure 1:
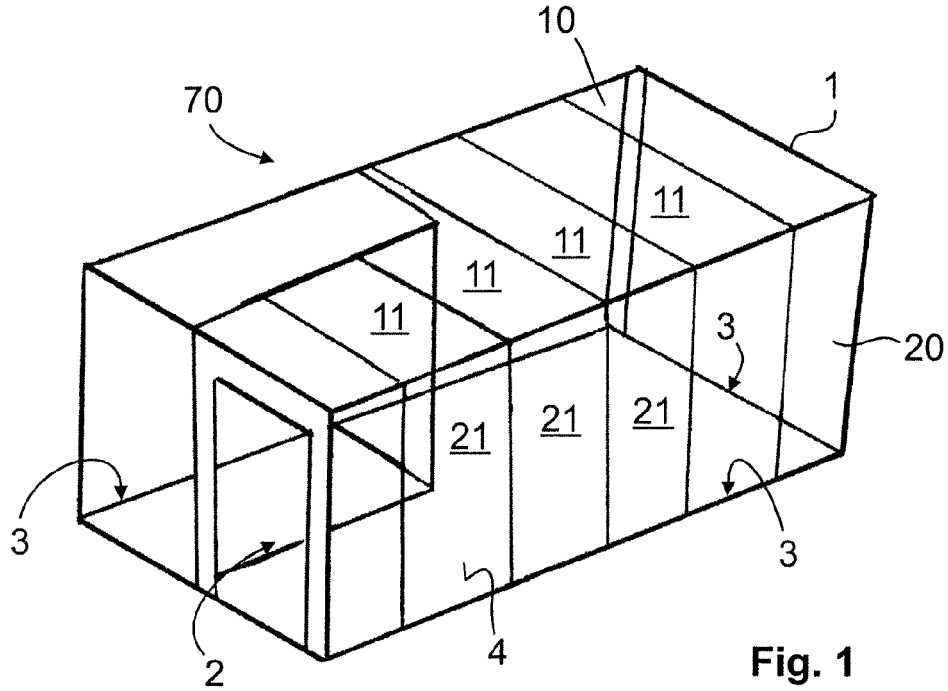
FIG. 1 shows a schematic view of a cabin composed of a ceiling and multiple walls.
Figure 9:
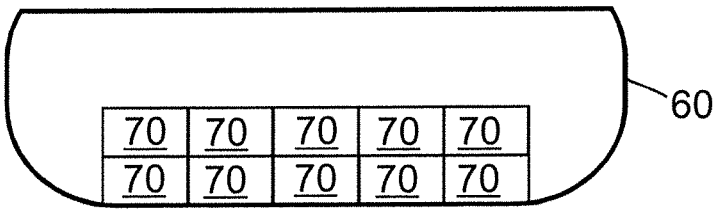
FIG. 9 shows a schematic view of a ship that is equipped with a multiplicity of cabins.

FIG. 1 shows a cabin 70 that can be installed in a ship 60 as per FIG. 9. As can be seen in FIG. 9, the ship 60 has a multiplicity of cabins 70 which are situated on different levels (decks). Each cabin 70 is equipped with supply conduits 30 such that electricity, lighting and air (by way of an air-conditioning system), for example, are available to each passenger in the cabin 70. It is likewise conceivable for waste water to be able to be discharged from the cabin 70 via the supply conduits 30. The passenger can likewise receive audible information via the supply conduits 30. It is furthermore possible for the user in the cabin 70 to be provided, via the conduits 30, with a network connection in order that they can receive and/or exchange electronic data. It is thus possible for any form of information technology to likewise be integrated into the conduits 30.

As shown in FIG. 1, the cabin constitutes a room unit 1 which is composed of a ceiling 10 and multiple walls 20. A wet room, for example, may be integrated in the cabin 70, wherein an entrance door and/or a window port may additionally be provided.

Figure 2:
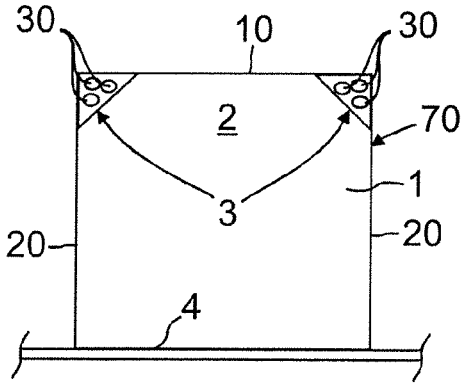
FIG. 2 shows a possible exemplary embodiment of a cabin which is equipped, at the ceiling region, with supply conduits.
Figure 3:
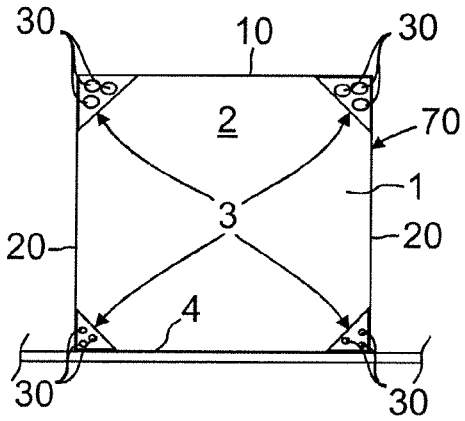
FIG. 3 shows a further exemplary embodiment of a cabin which is formed with supply conduits both at the ceiling region and also at the floor region.

FIG. 2 and FIG. 3 schematically show that the conduits 30 may run in the edge region 3 between the ceiling 10 and the wall 20 and/or in the edge region 3 between the wall 20 and the floor 4 of the room unit 1. By virtue of the conduits 30 being integrated in the room unit 1, the cabins 70 can be reduced in height, such that overall, the number of cabins in a ship can be increased, whereby the profitability of a ship can be increased considerably.

The arrangement of the supply conduits 30 along the longitudinal extent of the room unit 1 additionally has the effect that the cabin 70 is made more torsionally and flexurally rigid, which is a great advantage during the transportation of the cabin 70 and when the cabin 70 is installed on the respective ship deck.

Figure 4:
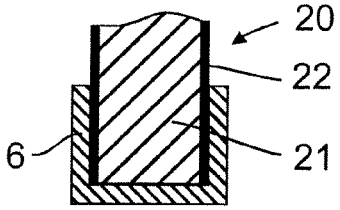
FIG. 4 shows a possible exemplary embodiment for the fastening of a wall element of a cabin to the floor of the ship.

In the exemplary embodiment shown as per FIG. 1, the cabin 70 does not have a separate floor, such that the room unit 1, formed by four walls 20 and a ceiling 10, is initially open at the floor side. Said box 1, which is open on one side, is placed onto the ship floor and fastened to the floor 4 for example as per FIG. 4. In the present exemplary embodiment, a frame profile 6 is provided on the floor 4, which frame profile holds the walls 20 in a reliable manner. The frame profile 6 is for example in the form of a U-shaped profile, as per FIG. 4. The geometric design of the U-shaped profile 6 is correspondingly adapted to the dimensions of the wall 20, such that the wall 20 is held in the U-shaped profile 6 in positively locking fashion. The U-shaped profile 6 is welded to the ship floor 6, thus ensuring a reliable fastening of the cabin 70 to the ship deck.

Figure 5:
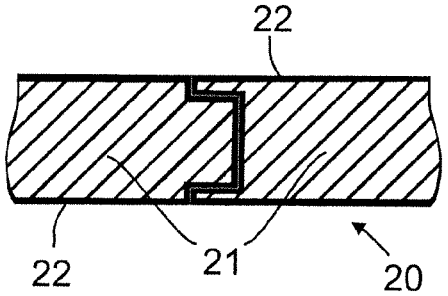
FIG. 5 shows a sectional view along two wall elements arranged adjacent to one another.

As is also shown in FIG. 1, the ceiling 10 and the walls 20 are formed from a multiplicity of ceiling elements 11 and wall elements 21, which are fastened to one another by way of a tongue and groove connection 5, as per FIG. 5. Each ceiling element 11 and wall element 21 is composed of a defined inner material which is encompassed by thin sheet metal 12. The inner material is preferably rigid, and meets all fire safety requirements. The inner material may likewise advantageously have an insulating effect, wherein it may alternatively and/or additionally perform sound-insulating functions. The individual ceiling elements 11 and wall elements 21, which may also be referred to as panels, may additionally be screwed to one another in the region of the tongue and groove connection 5. The thickness of the sheet metal 12 may for example be less than 1 mm.

Figure 6:
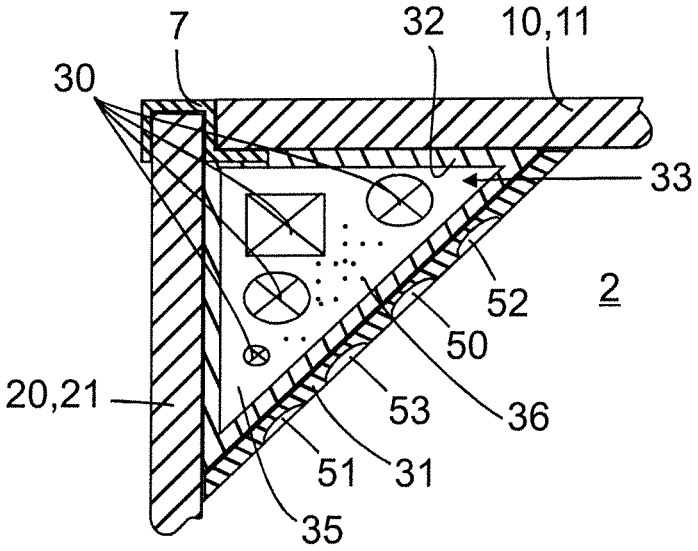
FIG. 6 shows an exemplary embodiment of a possible arrangement of supply conduits in the region of the cabin.
Figure 7A:
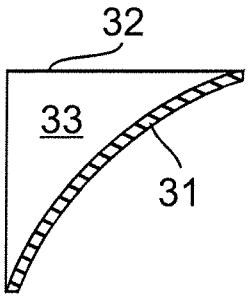
FIG. 7*a* shows a further exemplary embodiment for the arrangement of the supply conduits in the cabin.
Figure 7B:
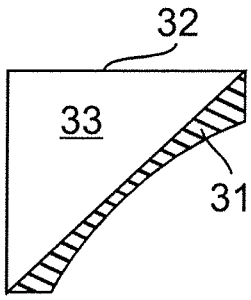
FIG. 7*b* shows yet a further exemplary embodiment for the arrangement of the supply conduits in the cabin.
Figure 7C:
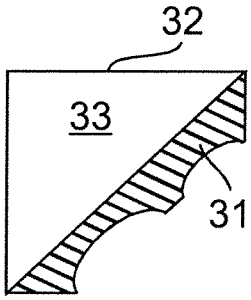
FIG. 7*c* shows an additional example for the arrangement of the supply conduits in the cabin.
Figure 8:
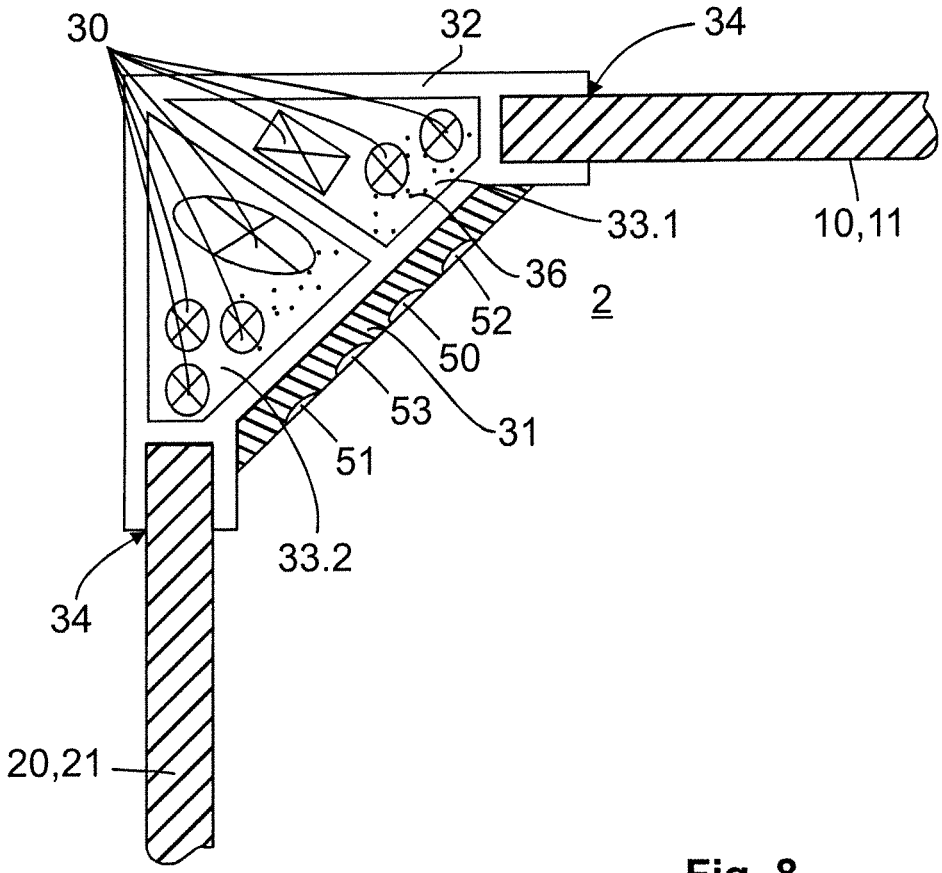
FIG. 8 shows a further example for the arrangement of the supply conduits in the region of the cabin.

FIG. 6 to FIG. 8 show by way of example that the conduits 30 may be equipped with a cover element 31, such that the conduits 30 are concealed from the interior 2 of the room unit 1. Here, different geometrical forms of the cover element 31 are conceivable, these also being shown in FIG. 7*a* to FIG. 7*c*. In FIG. 6 and FIG. 8, the cover element is arranged at 45° with respect to the wall 20 and with respect to the ceiling 10. Alternatively, the cover element 31 may have an extent similar to a segment of a circle, as per FIG. 7*a*. Further variants regarding the geometry of the cover element 31 are shown in FIG. 7*b* and FIG. 7*c*.

The cover element 31 as per FIG. 6 to FIG. 8 is advantageously removable, thus permitting access to the supply conduits 30 from the interior 2 of the room unit 1. This makes it significantly easier for a technician to perform repair work or maintenance work on the conduits 30 from the interior 2 of the cabin 70. Ease of installation is further increased if the cover element 31 is detachably fastened in the region of the conduits 30 by way of a simple connecting means. It is advantageous for the cover element 31 to be arranged on the conduits 30 by way of a detent connection and/or clip-type connection. As is schematically shown in FIG. 6 and FIG. 8, the conduits 30 extend through a metallic receiving body 32. As per FIG. 6, the receiving body 32 is fastened to a metallic frame 7, wherein at the same time, the wall 20 and the ceiling 10 are reliably fixed to the frame 7. To one side, the frame 7 has a U-shaped profile 6 in which the wall 20 is held in positively locking fashion. To the other side, the frame 7 has a support surface on which the ceiling 10 is supported in contiguous fashion. Furthermore, the wall 20 and the ceiling 10 may be fixed to the frame 7 by way of non-positively locking and/or positively locking and/or cohesive fastening means.

The receiving body has a chamber 33 in which there extend various conduits 30 which can serve for providing a supply, for example of air, water, data, electricity, lighting, etc., to the cabin. By way of example, it is shown that a lighting element 50, a sensor 51 and a loudspeaker 52 are arranged on the cover element 31. The sensor 51 is a motion sensor which is coupled to the lighting element 50. The lighting element 50 is activated only in the event of a defined movement within the cabin.

FIG. 8 shows a further exemplary embodiment of a receiving body 32 which has two chambers 33.1, 33.2, through each of which various supply conduits 30 extend. Furthermore, the receiving body 32 has two fastening receptacles 34 to which the wall 20 and the ceiling 10 are fastened. In the exemplary embodiment illustrated, the fastening receptacles 34 are in the form of U-shaped profiles 6 in which the ceiling 10 and the wall 20 are reliably held in each case in positively locking fashion.

The space 35 between the conduits 30 may advantageously be filled with a material 36, as per FIG. 6 and FIG. 8. In this way, it is possible for any rattling noises, which are generated for example as a result of contact between the conduits 30 and the metallic receiving body 32, to be prevented.

Various elements are also incorporated in the cover element 31 as per FIG. 8: a lighting element 50, a sensor 51, a loudspeaker 52, and air outlet and/or inlet openings 53.

Figure 10:
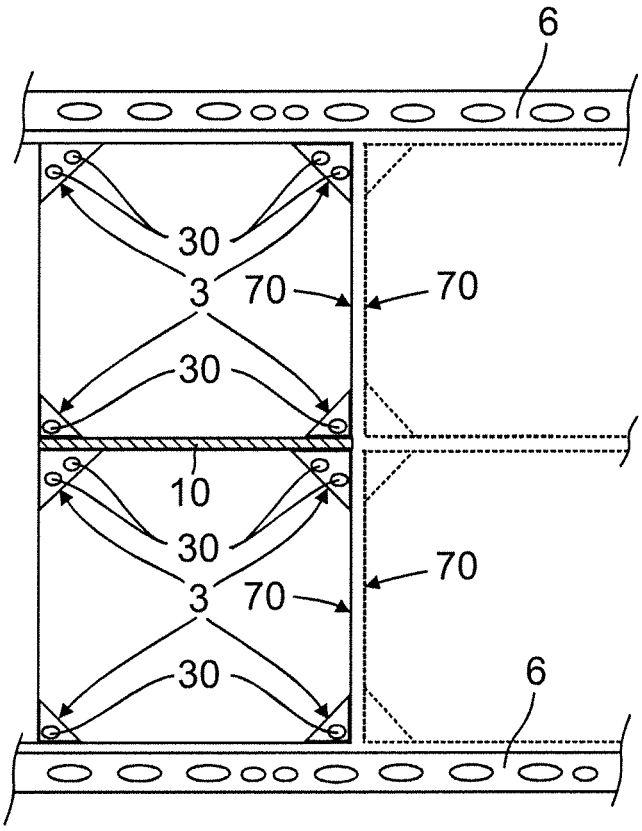
FIG. 10 shows a schematic view of a possible arrangement of cabins in a ship.

FIG. 10 shows a further alternative of a possible arrangement of ship cabins 70 within a ship. Each cabin has conduits 30, such as have already been described with reference to FIG. 1 to FIG. 8 in different variants, as stiffening means in the edge regions 3. The possible embodiments of the conduits as per FIG. 1 to FIG. 8 may self-evidently also be used in FIG. 10. However, FIG. 10 shows that, by means of an arrangement of cabins 70 one on top of the other, the structural height of the ship can be reduced considerably. FIG. 10 shows a double-deck arrangement of cabins 70, with two frame profiles 6 being provided which delimit the double-deck arrangement at the top and at the bottom. The ceiling 10 of the lower cabin 70 simultaneously constitutes the floor of the upper cabin 70. The structural height of the ship can be reduced considerably in this way.

LIST OF REFERENCE SIGNS

1 Room unit
2 Interior of 1
3 Edge region
4 Floor
5 Tongue and groove connection
6 Frame profile, U-shaped profile
7 Frame
10 Ceiling
11 Ceiling element
12 Sheet metal
20 Wall
21 Wall element
22 Sheet metal
30 Conduit
31 Cover element
32 Receiving body
33 Chamber
33.1 Chamber
33.2 Chamber
34 Fastening receptacle
35 Space for 36
36 Material, felt
50 Lighting element
51 Sensor
52 Loudspeaker
53 Air outlet/inlet opening
60 Ship
70 Cabin

The invention claimed is:

1. A cabin for a floating installation comprising: a room unit delimited at least by a ceiling, a floor, a metallic frame profile fastened to the floor, walls formed from a multiplicity of wall elements fastened to one another and held in the frame profile, and conduits for providing a supply of air, water, data, electricity, and/or lighting to the room unit, the conduits running in the room unit such that the conduits simultaneously act as stiffening members for the room unit, the conduits extend through a metallic receiving body that is fastened to the ceiling and/or to the wall and/or to a floor, the receiving body has mutually separate chambers in which the conduits extend, each of the chambers having a space in which the conduits are situated, and the space being filled with a material for preventing movements of the conduits within the chamber.

2. The cabin of claim 1, wherein the conduits are integrated in the room unit such that the conduits are accessible from an interior of the room unit.

3. The cabin claim 1, wherein the conduits are arranged in an edge region between the ceiling and the wall and/or in an edge region between the wall and a floor of the room unit.

4. The cabin of claim 1, further comprising a cover element that covers the conduits with respect to an interior of the room unit.

5. The cabin of claim 4, wherein the cover element is removable.

6. The cabin of claim 1, wherein the ceiling is formed from a multiplicity of ceiling elements that are fastened to one another.

7. A ship comprising a plurality of cabins in accordance with claim 1, wherein the cabins are arranged one on top of the other and/or adjacent to one another.

8. A cabin for a floating installation comprising: a room unit delimited at least by a ceiling, walls, conduits for providing a supply of air, water, data, electricity, and/or lighting to the room unit, the conduits running in the room unit such that the conduits simultaneously act as stiffening members for the room unit, and at least one cover element that covers the conduit with respect to an interior of the room unit, the cover element having at least one of a lighting element, a sensor, a loudspeaker, a display, a plug socket, network connection, a sprinkler element, a camera, and an air outlet/inlet opening.

9. The cabin of claim 8, wherein the conduits extend through a receiving body that is fastened to the ceiling and/or to the wall and/or to a floor, the receiving body being metallic.

10. The cabin of claim 9, wherein the receiving body has mutually separate chambers in which the conduits extend.

11. The cabin of claim 10, wherein the receiving body has at least one fastening receptacle on which the wall and/or the ceiling is arranged.

12. The cabin of claim 11, wherein the fastening receptacle has a U-shaped profile.

13. The cabin of claim 10, wherein the chamber has a space in which the conduits are situated the space being filled with a material for preventing movements of the conduits within the chamber.

14. A cabin for a floating installation comprising: a room unit delimited at least by a ceiling, walls connected perpendicularly to the ceiling at corners and conduits extending along the corners of the room unit, each of the conduits having a ceiling panel supported against the ceiling, a wall panel supported against one of the walls and a diagonal panel extending diagonally between the ceiling and the wall of the corner along which the conduit extends, each of the conduits defining an elongated chamber of substantially triangular cross-section for providing a supply of air, water, data, electricity, and/or lighting to the room unit, and the conduits simultaneously acting as stiffening members for the room unit, wherein the ceiling and the walls are formed from a multiplicity of ceiling elements and wall elements, each of the ceiling elements being fastened to the ceiling element adjacent thereto by way of a tongue and groove connection, and/or each of the wall elements being fastened to the wall element adjacent thereto by way of a tongue and groove connection.

15. The cabin of claim 14, further comprising a metallic frame profile fastened to the floor of the room unit, wherein the wall elements are held in the frame profile.

* * * * *